United States Patent [19]

Agapiou

[11] Patent Number: 4,493,124

[45] Date of Patent: Jan. 15, 1985

[54] TOILET CLEANING TOOL

[76] Inventor: Michael Agapiou, 163 Watford Rd., Harrow, Middlesex, HA1 3UA, England

[21] Appl. No.: 436,696

[22] Filed: Oct. 26, 1982

[30] Foreign Application Priority Data

Oct. 27, 1981 [GB] United Kingdom ..... 8132404

[51] Int. Cl.[3] ..... A47L 25/00

[52] U.S. Cl. ..... 15/104.94; 15/150; 15/210 R; 15/228; 15/244 R

[58] Field of Search ..... 15/104.94, 147 R, 147 A, 15/147 C, 149, 150, 209 R, 210 R, 228, 244 R

[56] References Cited

U.S. PATENT DOCUMENTS

| | | | |
|---|---|---|---|
| 877,585 | 1/1908 | Nicolai | 15/210 R |
| 1,192,330 | 7/1916 | Leppart | 15/150 |
| 1,631,791 | 6/1927 | Buckley | 15/210 R |
| 2,666,223 | 1/1954 | Farrell | 15/210 R |
| 2,755,497 | 7/1956 | Greacen, Jr. | 15/104.94 X |
| 3,214,778 | 11/1965 | Mathison | 15/244 R |
| 3,383,158 | 5/1968 | Leland | 15/147 R |
| 3,619,280 | 11/1971 | Scheuer | 15/210 R |
| 4,031,673 | 6/1977 | Hagelberg | 15/104.94 X |

FOREIGN PATENT DOCUMENTS

| | | | |
|---|---|---|---|
| 290403 | 2/1916 | Fed. Rep. of Germany . | |
| 2826890 | 1/1980 | Fed. Rep. of Germany | 15/24 R |
| 170012 | 9/1934 | Switzerland | 15/147 C |
| 710524 | 6/1954 | United Kingdom . | |
| 897556 | 5/1962 | United Kingdom . | |
| 1532457 | 11/1978 | United Kingdom . | |

*Primary Examiner*—Edward L. Roberts

*Attorney, Agent, or Firm*—Fleit, Jacobson, Cohn & Price

[57] ABSTRACT

A toilet cleaning tool for cleaning a lavatory bowl of a toilet, which toilet cleaning tool comprises a disposable cleaning member and a body, the body having an elongate handle and first and second parts between which the disposable cleaning member is releasably retained, and the disposable cleaning member being water degradable whereby the disposable cleaning member can be disposed of by being flushed down the toilet.

4 Claims, 16 Drawing Figures

TOILET CLEANING TOOL

This invention relates to cleaning tools and more especially it relates to a toilet cleaning tool for cleaning a lavatory bowl of a toilet.

Lavatory bowls are normally cleaned at present either with a manual brush comprising a long handle and an integral fixed brush head, or with liquid chemicals or chemical blocks. The brush is efficient but unpleasant to store and difficult to keep hygenically clean. The liquid chemicals or chemical blocks, which are placed in the lavatory bowl itself or in a cistern which supplies the lavatory bowl with water for flushing purposes, are much more pleasant to use than a brush, but they are less effective and sooner or later the added assistance of manual brushing is required.

It is an aim of the present invention to provide a toilet cleaning tool for cleaning a lavatory bowl of a toilet, which toilet cleaning tool offers the cleaning action of a manual brush but which can be kept hygenically clean.

Accordingly, this invention provides a toilet cleaning tool for cleaning a lavatory bowl of a toilet, which toilet cleaning tool comprises a disposable cleaning member and a body, the body having an elongate handle and first and second parts between which the disposable cleaning member is releasably retained, and the disposable cleaning member being water degradable whereby the disposable cleaning member can be disposed of by being flushed down the toilet.

Preferably, the toilet cleaning tool is one in which the first and second parts of the body are moveable between open and closed positions, and in which the first part of the body has an aperture through which the disposable cleaning member projects when the first and second parts of the body are in their closed position for retaining the disposable cleaning member, the first and the second parts of the body being such that the disposable cleaning member is released for disposal merely by moving the first and the second parts of the body to their open position. It will thus be apparent that the disposable cleaning member can easily be disposed of and that it will not be necessary to touch the disposable member when it is in a soiled condition in order to effect its disposal.

Preferably, the second part of the body comprises a tray on which the disposable cleaning member rests, the tray being effective to support the disposable cleaning member and to force it through the aperture in the first part when the first and the second parts are in their closed position.

The tray may be perforated to allow a good circulation of water to the disposable cleaning member.

In an alternative embodiment of the invention, the toilet cleaning tool may be one in which the first and second parts of the body are movable between open and closed positions, and in which the first and the second parts are held in their closed position in which they grip the disposable cleaning member by a sleeve member which is slidable backwards and forwards over the elongate handle.

The first and the second parts of the body may be formed to extend so as to define the elongate handle.

The disposable cleaning member may be made of paper and/or fibre. The fibre is preferably a cellulose fibre. The disposable cleaning member may also be a chemical block.

The disposable cleaning member may be impregnated with a cleaning agent. The cleaning agent may be a detergent which may include a foaming agent and/or bleach. Advantageously, the disposable cleaning member is impregnated with a chemical air freshening agent such for example as a perfume. The disposable cleaning members can thus freshen the air where they are stored prior to being used to clean the toilet.

The disposable cleaning member is preferably a pad. The disposable cleaning pad may have a flange or a shoulder which is gripped between the first and the second parts of the body of the toilet cleaning tool.

The first and second parts of the body of the toilet cleaning tool may be hinged at the elongate handle end thereof.

The first and second parts of the body of the toilet cleaning tool may be made of a moulded plastics material. Typical plastics materials are Nylon and polyvinyl chloride.

The toilet cleaning tool may be used in combination with a dispenser for dispensing fresh disposable cleaning members directly to the body of the toilet cleaning tool. The use of such a dispenser is advantageous in that the end of the toilet cleaning tool that holds the disposable cleaning member does not have to be touched. The dispenser may be made from the same type of materials that are used for the body of the toilet cleaning tool.

Some embodiments of the invention will now be described solely by way of example with reference to the accompanying drawings, in which corresponding features of the various Figures bear where appropriate the same designations and in which:

FIG. 1*a* is a perspective view of one part of a first cleaning tool;

FIG. 1*b* is a perspective view of a cleaning member for use with the part shown in FIG. 1*a;*

FIG. 1 is a perspective view of the other part of the cleaning tool which is complementary to the part shown in FIG. 1*a;*

Figure 4A:
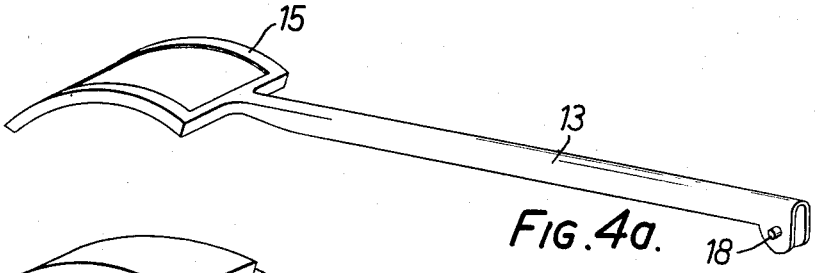
Figure 4B:
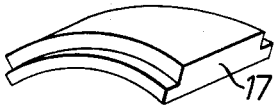

FIG. 4*a* is a perspective view of one part of a second cleaning tool, the cleaning tool having a convex frame;

FIG. 4*b* is a pad for use with the cleaning tool part shown in FIG. 4*a;*

Figure 4C:
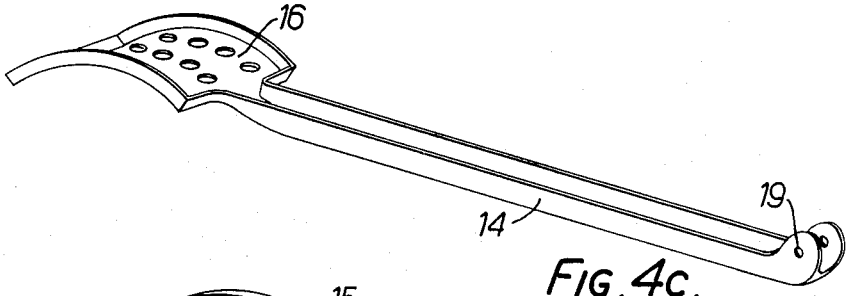

FIG. 4*c* is a perspective view of a convex tray arm for use with the part shown in FIG. 4*a;*

Figure 5:
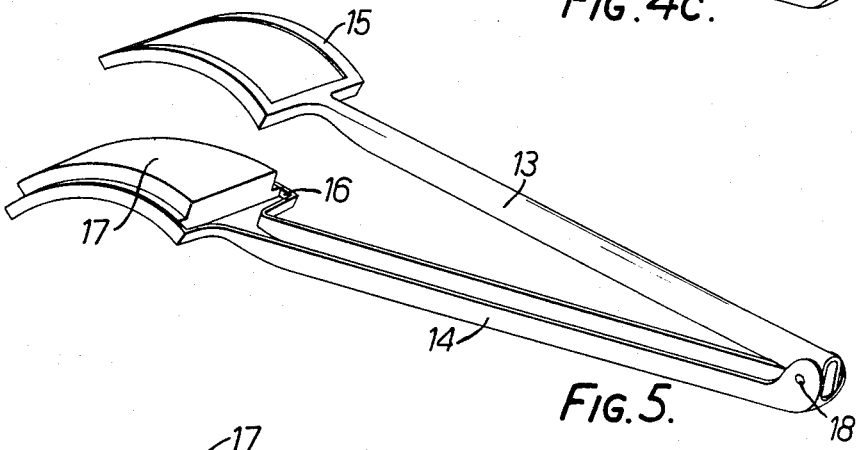
Figure 6:
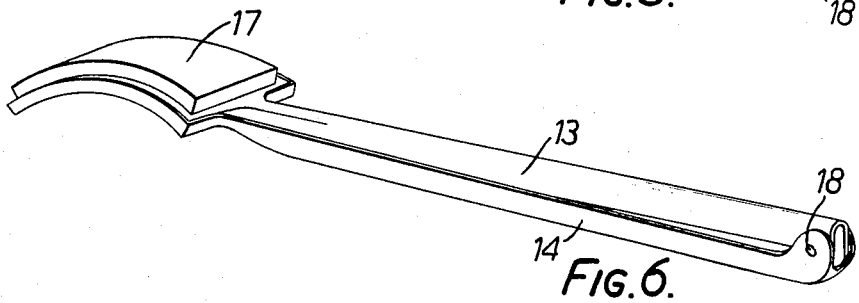
Figure 7:
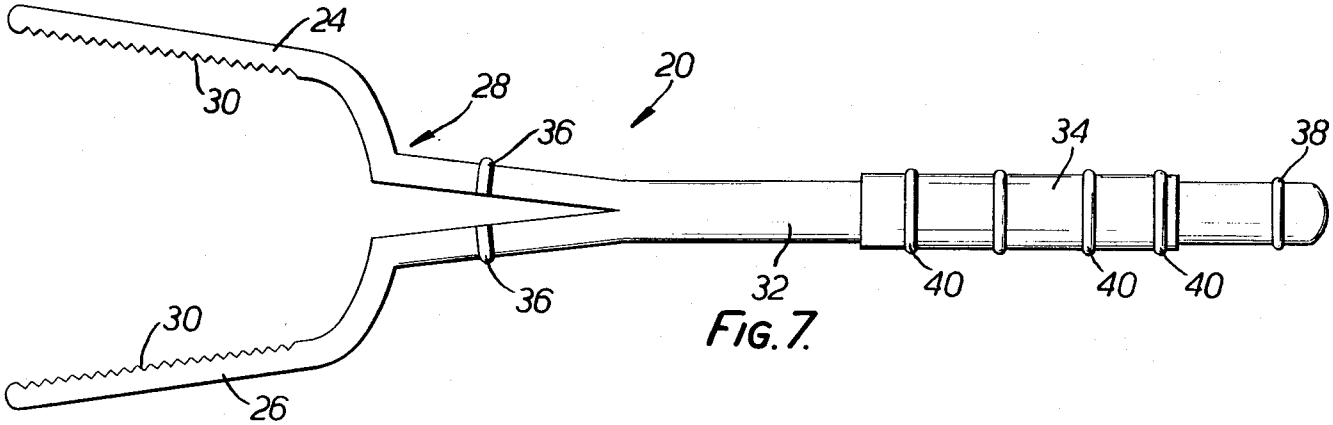
Figure 8:
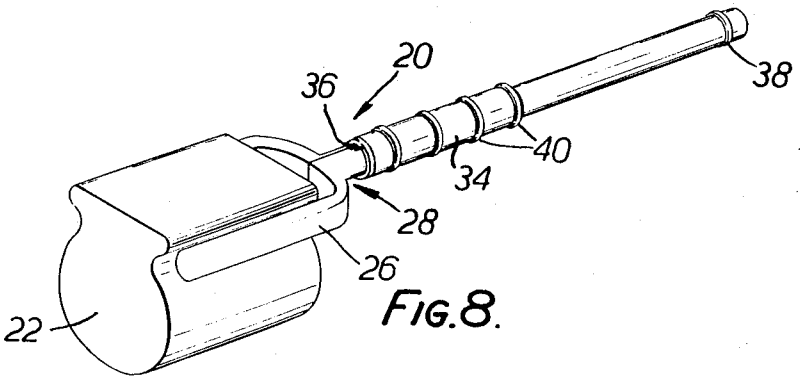
Figure 9:
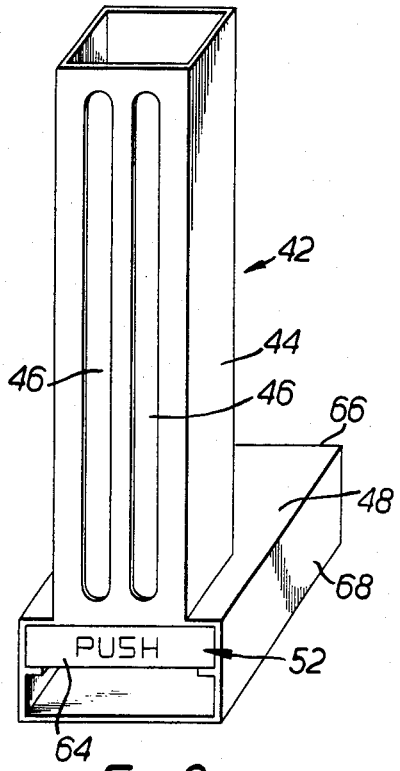
Figure 10:
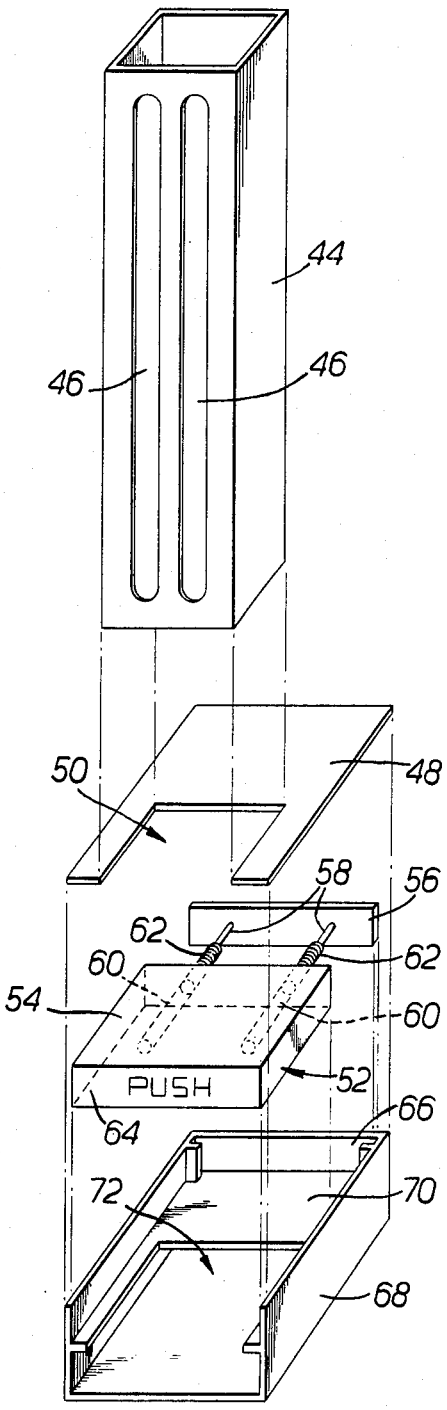
Figure 11:
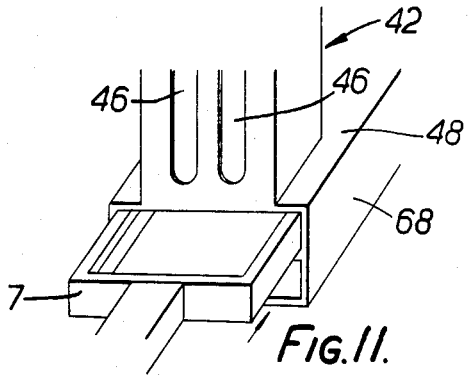

FIG. 5 is a perspective of the parts shown in FIGS. 4*a,* 4*b* and 4*c* assembled in an open position;

FIG. 6 is a perspective view of the parts shown in FIGS. 4*a,* 4*b* and 4*c* assembled in a closed position;

FIG. 7 is a plan view of a third cleaning tool;

FIG. 8 is a perspective view of the cleaning tool of FIG. 7 in a closed position and gripping a cleaning member;

FIG. 9 is a perspective view of a dispenser for dispensing cleaning members;

FIG. 10 is an exploded view of the dispenser shown in FIG. 9;

FIG. 11 shows an operating detail of the dispenser shown in FIG. 9; and

Figure 12:
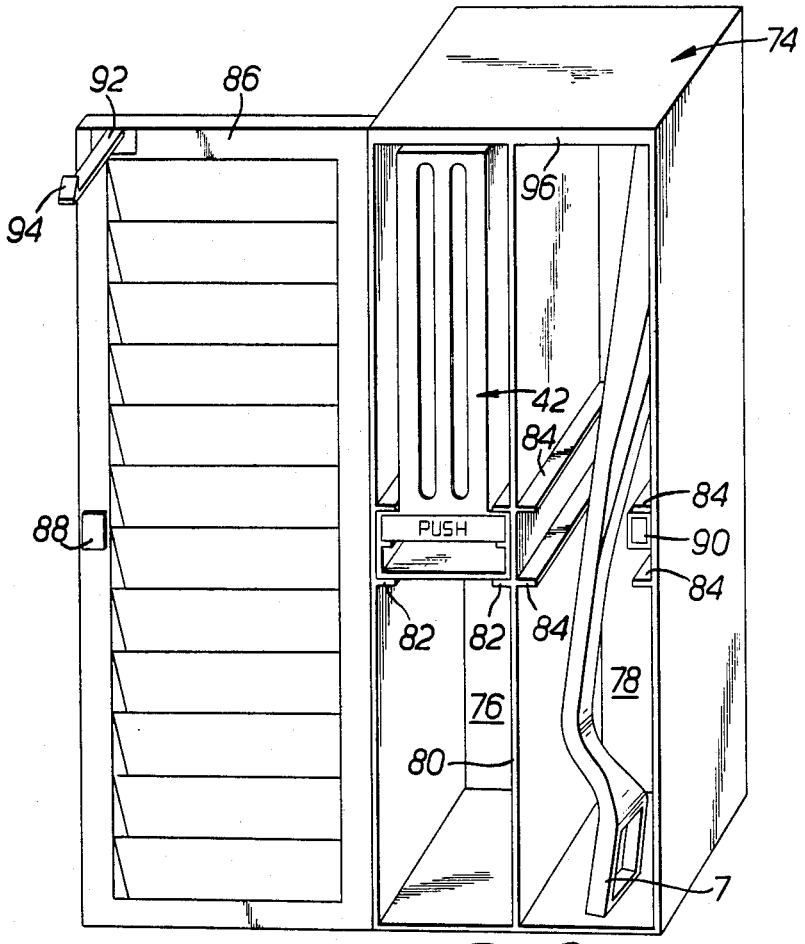

FIG. 12 shows the dispenser of FIG. 9 positioned in a storage cupboard.

Referring now to FIGS. 1*a*, 1*b* and 1*c*, FIG. 2 and FIG. 3, a cleaning tool comprises first and second body parts 1 and 2 respectively, the body part 1 having a curved handle portion 3 and a frame part 4 including an aperture 5. The body part 2 includes a perforated tray 7 and handle portion 6, which is complementary with the handle portion 3 of the part 1. The tray 7 is arranged to receive a cleaning member in the form of a disposable cleaning pad 8 having flanges or shoulders 9. The parts 1 and 2 are arranged to fit together with ends 10 and 11 of the parts 1 and 2 respectively hinged about a hinge pin 12, shown in the part 1, which extends through holes 13 in the part 2.

Figure 1A:
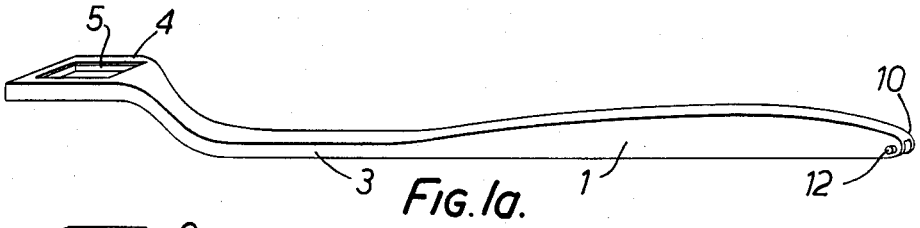
Figure 1B:
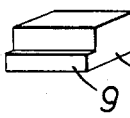
Figure 1C:
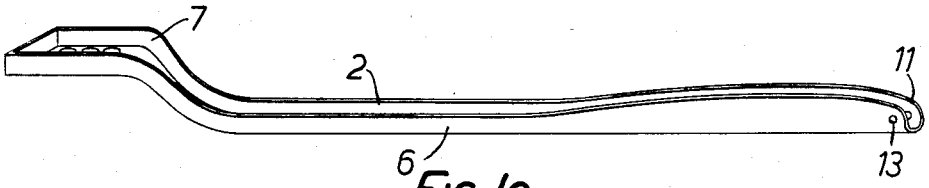
Figure 2:
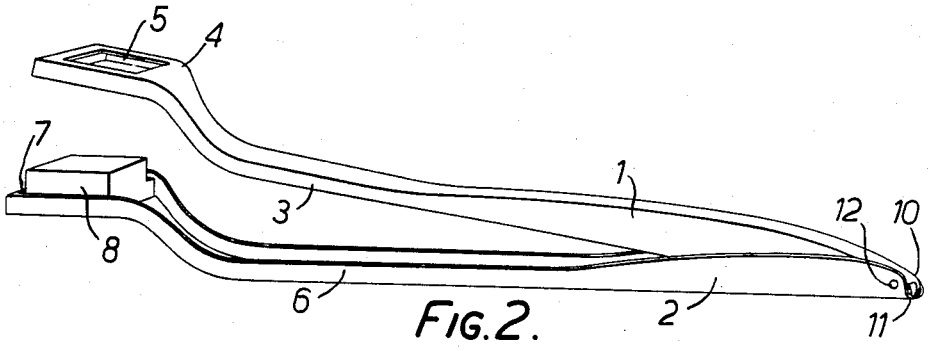
FIG. 2 is a perspective view of the parts shown in FIGS. 1*a,* 1*b* and 1*c* assembled in an open position.
Figure 3:
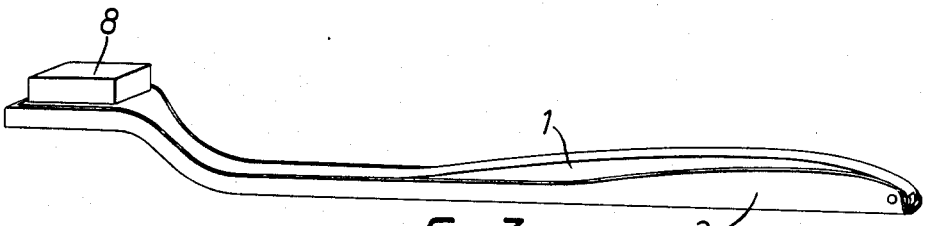
FIG. 3 is a perspective view of the parts shown in FIGS. 1*a,* 1*b* and FIG. 1*c* assembled in a closed position.

As shown most clearly in FIG. 3, the parts 1 and 2 fit together so that the frame 4 traps the cleaning pad 8 in the tray 7.

Referring now to FIGS. 4*a*, 4*b*, and 4*c*, FIG. 5 and FIG. 6, in an alternative embodiment of the invention, a toilet cleaning tool is provided with a straight handle comprising two parts 13 and 14. The part 13 is provided with a convex frame 15 and the part 14 is provided with a perforated complementary convex tray 16. A cleaning pad 17 is provided which is curved, or which can be deformed to conform to the curvature of the tray 16, the pad being placed in the tray 16 and secured in position by means of the frame 15. The part 13 is provided at one end with a hinge pin 18 which fits in complimentary holes 19 of the part 14 whereby the two parts are hinged together.

In the foregoing embodiments, it is arranged that the parts 1 and 2, or 13 and 14, are held together in use by a user's hand as it embraces the handle, whereby the pad 8 or 17 is firmly retained in position and can easily be ejected after use and flushed away.

The parts 1 and 2, or 13 and 14, may be made of moulded plastics material such as nylon. The handle parts 3 and 6, may be about 36 cm long by 1.5×2 cm, broadening out into the shallow tray 7 which may be about 1 cm deep by 6 cm wide and 8 cm long. It will be appreciated that when the two parts of the handle are separated, the pad 8 will drop out under gravity to be disposed of.

The pad 8 is made by compressing together layers of tissue paper or fibre soaked in a solution of a cold water activated foaming cleanser, bleach and fragrent smelling air freshening substance. A colouring agent to aid cosmetic appeal may also be employed in the solution. The compressed layers of tissue paper are then dried. If desired, the dried and compressed pads can be given a top spray of the cleanser/bleach/fragrant smelling substance before being packaged for sale. The pad 8 may also be made by extruding paper pulp or fibre bound together by the same chemical agent. In this case, paper pulp or fibre granules may be mixed with a solution of the cleanser/bleach/fragrant smelling substance. The resultant mixture can be aerated with carbon dioxide and extruded through a die as a continuous ribbon. The ribbon can then be dried and cut into appropriately sized pads. The pads may be given a top spray of the cleanser/bleach/fragrant smelling substrate before being packaged for sale.

The chemicals on the pad 8 not only facilitate easier cleaning, but also because of their binding nature on the pad 8, they facilitate slow disintegration of the pad 8 as they dissolve in the water. The pads 8 are designed to be of a size whereby they can be easily flushed from a lavatory bowl even when fully saturated with water. The flushing action also greatly speeds the disintegration of the pad, making it incapable of blocking either the household soil pipe, or the community sewage system. An ideal size of the pad when dry may be 6 cm×6 cm×2 cm.

The pad 8 is compressed in such a way as to form the flanges or shoulders 9 which are about 1 cm wide and 1 cm deep and which run along two opposing sides. It will be appreciated that it is these shoulders 9 that are held down against the tray 7 by the frame part 4 and which allow the pad 8 to stand proud of the frame part 4 by approximately 1 cm.

Before the pads are packed for sale they may advantageously be given a top coating of water-activated bleach and cleanser in order to provide an obvious chemical reaction immediately the pad is placed in water. Perfumed air freshening material may also be added if desired.

Referring now to FIGS. 7 and 8, there is shown a toilet cleaning tool 20 comprising a disposable cleaning member in the form of a pad 22 which is positionable between first and second parts 24, 26 respectively of a body 28 of the toilet cleaning tool 20. The first and second parts 24, 26 are provided with serrated edges 30 as shown for gripping the pad 22.

The first and second parts 24, 26 extend into an elongate handle 32. A sleeve 34 is positioned over the handle and when it is pushed forwardly to the position illustrated in FIG. 8, the first and second parts 24, 26 are brought together and they grip the pad 22 as illustrated. The body 28 is provided with stops 36 for preventing the sleeve 34 from being pushed too far. The handle 32 is also provided with a stop 38 for preventing the sleeve 34 from sliding off the rear end of the handle 32. The sleeve 34 is provided with ribs 40 for enabling the sleeve 34 easily to be gripped.

The first and second parts 24, 26 and the handle 32 will usually be made of a fairly rigid plastics material and the first and second parts 24, 26 will tend to spring apart to their open position as illustrated in FIG. 7 due to the inherent resiliency of the plastics material. The sleeve 34 may also be made from a plastics material but the plastics material for the sleeve 34 will usually be of a relatively softer material than that employed for the remainder of the toilet cleaning tool 20.

Referring now to FIGS. 9, 10 and 11, there is shown a dispenser 42 comprising a tower 44 which is hollow as shown and which is for receiving a stack of disposable cleaning members one on top of the other. The disposable cleaning members are a loose sliding fit in the tower 44 and they fall under gravity as will be explained in more detail hereinbelow. The tower 44 is provided with a pair of elongate ventilation slots 46 through which the air freshening contents of the disposable cleaning members can escape into the atmosphere and thereby freshen the place, e.g. the toilet room, where the dispenser 42 is located.

As shown in FIG. 10, the base part 48 of the tower 44 is provided with an aperture 50 of the same general dimensions as the interior of the tower 44. When a stack of disposable cleaning members are positioned in the tower 44, the lowermost cleaning member will be located in the aperture 50 and it will sit on a push-in platform device 52. The platform device 52 is shown most clearly in FIG. 10 and it comprises a platform 54, a back plate 56, a pair of rods 58 which are slidable in bores 60 in the platform 54, and a pair of coil springs 62 which are positioned over the rods 58. In use of the dispenser 42, the body part 2 of the toilet cleaning tool shown in FIGS. 1 to 3 for example, is used to push on the front face 64 of the platform 54 whereupon the entire platform 54 will move inwardly towards the rear plate 56, the rear plate 56 itself being located against a rear wall 66 of the housing 68 containing the platform device 52. As the platform 54 moves towards the back plate 56, the springs 62 are compressed and the rods 58 penetrate deeper and deeper into the bores 60. When the platform 54 has been pushed sufficiently far towards the back plate 56, the platform 54 will be clear of the aperture 50 and the lowermost disposable cleaning member can fall through the aperture 50 and into position in tray 7 of the body part 2 of the toilet cleaning tool.

More specifically, the lowermost surface of the platform 54 slides on a shelf member 70 which is provided with an aperture 72. The apertures 50 and 72 are substantially identical. As the disposable cleaning member passes through the aperture 50, it will also pass through the aperture 72 and into the tray 7 which will be located in the apertures 50, 72 as shown in FIG. 11. It will thus be apparent that the disposable cleaning member is located in the tray 7 without the need to touch the toilet cleaning tool in the region of the tray 7. As the tray 7 is withdrawn from the dispenser 42, the springs 62 will force the platform 54 back to the position illustrated in FIGS. 9 and 10 in which the platform 54 blocks the aperture 50. The next lowermost disposable cleaning member will then be in position resting on the platform 54 ready for the next dispensation to the tray 7.

Referring now to FIG. 12, there is shown a cupboard 74 having a pair of interior compartments 76, 78 which are separated from one another by a dividing wall 80. Located in the upper part of the compartment 76 is the dispenser 42. The housing 68 of the dispenser 42 slides as shown in a pair of guide rails 82. The compartment 78 is also provided with a pair of similar guide rails 84 in case it may be desired to locate the dispenser 42 in the compartment 78 instead of in the compartment 76. The lower part of the compartment 76 is available for storing small toilet articles such for example as toilet rolls and spare disposable cleaning members. The compartment 78 as shown is available for storing the toilet cleaning tool, the toilet cleaning tool shown in FIG. 12 being that generally illustrated in FIGS. 1 to 3.

It will be seen that the cupboard 74 is provided with a louvered door 86. The door is provided with a magnetic catch part 88 which engages with a similar magnetic catch part 90 which is conveniently located against the upper part of the right hand rail 84 as shown in FIG. 12. The magnetic catch constituted by the parts 88, 90 is effective to keep the door 86 normally closed. The louvres in the door 86 enable the air freshening substance to escape into the atmosphere from the cupboard 74 after the air freshening substance has passed through the ventilation slots 46.

In order to prevent children from opening the cupboard 74 and possibly tampering with its contents, a childproof safety catch 92 is provided. The catch 92 is provided with a hook shaped end 94 and if the door 86 is opened without touching the catch 92, then the hook shaped end 94 hooks under a lip 96 formed in the top part of the cupboard 74. The hook shaped end 94 will only clear the lip 96 upon the application of relatively strong downward pressure to the catch 92, this pressure normally being too great for a child to produce.

The dispenser 42 and the cupboard 74 may be made from a plastics material. The portion of the base part 48 not occupied by the tower 44 may be adapted to receive the toilet cleaning tool in an upstanding position. Alternatively, the toilet cleaning tool can be hung from the dispenser 42, the dispenser 42 being provided with appropriate hanging means such for example as hooks. Advantageously, the dispenser 42 is stuck, screwed or otherwise secured to a suitable wall whereby firm loading of the toilet cleaning tool is facilitated. Also advantageously the top of the tower 44 and the part of the tower providing access to the platform 54 are provided with childproof covers in order to prevent undesirable contact with the disposable cleaning members by children.

It will be apparent that the cupboard 74 will be a relatively small item which can itself be stood on the floor or mounted on a wall. By way of example, it is mentioned that the cupboard 4 may be 14 inches high by 4 inches thick by 4 inches wide.

It is to be appreciated that modifications may be made to the arrangements shown above with reference to the accompanying drawings without departing from the scope of the invention. Thus, for example, the trays 7 and 16 may include a non-absorbent pad (for example a non-absorbent resilient pad) which projects through the aperture in the frame and on which may be placed a disposable heavy duty tissue or the like. Thus, two or thre sheets of ordinary toilet tissue may in this case be used instead of a disposable pad. If desired, the toilet tissue can be folded over to give a required thickness.

I claim:

1. A toilet cleaning tool for cleaning a lavatory bowl of a toilet, which toilet cleaning tool comprises a disposable cleaning member and a body, the body having first and second parts which define a handle and between which the disposable cleaning member is releasably retained, the disposable cleaning member comprising a centre cleaning portion and a pair of flanges, the disposable cleaning member being water degradable whereby the disposable cleaning member can be disposed of by being flushed down the toilet, the first and second parts of the body being movable between open and closed positions, the first part of the body having an aperture through which the centre cleaning portion of the disposable cleaning member projects when the first and the second parts of the body are in their closed position in which they sandwich the pair of flanges of the disposable cleaning member to retain the disposable cleaning member in position, the second part of the body comprising a tray on which the disposable cleaning member rests, the tray being effective to support the disposable cleaning member and to force the centre cleaning portion of the disposable cleaning member through the aperture in the first part when the first and the second parts of the body are in their closed position, the tray being perforated to allow a good circulation of water to the disposable cleaning member, and the first and the second parts of the body being such that the disposable cleaning member is released for disposal merely by moving the first and the second parts of the body to their open position whereby the disposable cleaning member is able to fall off of the tray under the action of gravity.

2. A toilet cleaning tool according to claim 1 in which the disposable cleaning member is made of a material selected from the group consisting of paper and cellulose fibre.

3. A toilet cleaning tool according to claim 1 in which the disposable cleaning member is impregnated with a chemical agent selected from the group consisting of a detergent, a foaming agent, bleach, and a chemical air freshening agent.

4. A toilet cleaning tool according to claim 1 and a dispenser for dispensing fresh disposable cleaning members directly to the body of the toilet cleaning tool, the dispenser having a first storage section for the fresh disposable cleaning members, the first storage section having a spring biased bottom wall which is forcible into an open position by the second part of the body of the toilet cleaning tool to allow a lower most fresh disposable cleaning member to drop onto the tray, and the dispenser having a second storage section for storing the toilet cleaning tool when the toilet cleaning tool is not in use.

* * * * *